US005339841A

United States Patent [19]

Gueret

[11] Patent Number: 5,339,841

[45] Date of Patent: Aug. 23, 1994

[54] MAKEUP DEVICE

[75] Inventor: Jean-Louis Gueret, Paris, France

[73] Assignee: l'Oreal, Paris, France

[21] Appl. No.: 8,546

[22] Filed: Jan. 25, 1993

[30] Foreign Application Priority Data

Jan. 24, 1992 [FR] France ..... 92 00773

[51] Int. Cl.[5] ..... A45D 40/26

[52] U.S. Cl. ..... 132/218; 132/320; 401/153

[58] Field of Search ..... 132/216, 218, 320; 401/153, 188 R, 190, 284

[56] References Cited

U.S. PATENT DOCUMENTS

| | | | |
|---|---|---|---|
| 3,428,404 | 2/1969 | Ciancio | 401/284 |
| 4,043,681 | 8/1977 | Funahashi | 401/153 |
| 4,705,053 | 11/1987 | Goncalves | 132/218 |
| 4,750,502 | 6/1988 | Ser et al. | 132/320 |
| 5,002,415 | 3/1991 | Gueret | 401/153 |
| 5,154,523 | 10/1992 | Devreeze | 401/153 |

FOREIGN PATENT DOCUMENTS

| | | | |
|---|---|---|---|
| 0045690 | 10/1982 | European Pat. Off. . | |
| 0208394 | 1/1987 | European Pat. Off. | 132/320 |
| 3538001 | 4/1987 | Fed. Rep. of Germany | 132/320 |
| 2659032 | 6/1991 | France . | |
| 314734 | 2/1934 | Italy | 401/153 |
| 155202 | 7/1956 | Sweden | 401/153 |
| 2227650 | 8/1990 | United Kingdom . | |
| 2241163 | 8/1991 | United Kingdom | 401/190 |

*Primary Examiner*—Gene Mancene
*Assistant Examiner*—Frank A. LaViola
*Attorney, Agent, or Firm*—Oliff & Berridge

[57] ABSTRACT

A makeup device includes a cylindrical body which can accommodate a sealed reservoir containing a viscous or pasty makeup product, especially a mascara, and is capable of dispensing a measured amount of the product contained in the reservoir through a nozzle in the front opening of the reservoir onto an applicator. The applicator is permanently mounted on the cylindrical body in the vicinity of the front end of the body and includes a shaft. At the end of the shaft is mounted an applying element, the shaft being provided with an internal passage terminating by at least one orifice at its periphery, and contacting with the nozzle in the front opening of the reservoir. The device also includes a cap capable of enclosing the applicator and capable of separably attaching to the body in the vicinity of the front end of the body.

19 Claims, 3 Drawing Sheets

MAKEUP DEVICE

TECHNICAL FIELD

The present invention relates to a makeup device, more specifically, a makeup device for applying a viscous or pasty makeup product such as mascara.

BACKGROUND

Devices for dispensing and applying a makeup product such as mascara usually consist of a body forming a reservoir for the product and having at one open end, a neck part on which a stopper can be mounted, preferably by screwing, said stopper being provided with an applicator consisting of a shaft bearing a brush at its end.

Therefore, the applicator is immersed in the product contained in the reservoir when the device is in the closed position.

When it is desired to apply the product, the applicator is released by removing the plug with which it is integral, and making up the eyelashes by applying the product on the brush.

Throughout the makeup operation, which can be relatively lengthy, the product in the reservoir is exposed to the air through the open end of the reservoir.

The majority of makeup products, especially mascaras, tend to lose their cosmetic properties in contact with the air, and in particular tend to dry out.

After a certain number of uses, a portion of the product still in the reservoir becomes unusable.

In addition, the product is at risk of being contaminated by microorganisms as a result of its exposure to the air.

SUMMARY OF THE INVENTION

The present invention proposes to provide a makeup device comprised of a reservoir in which the makeup product is permanently protected from the air, especially during the use of the device for makeup.

The present invention likewise proposes furnishing a makeup device which permits dispensing measured amounts of the product contained in the reservoir.

DETAILED DESCRIPTION OF PREFERRED EMBODIMENTS

Figure 1:
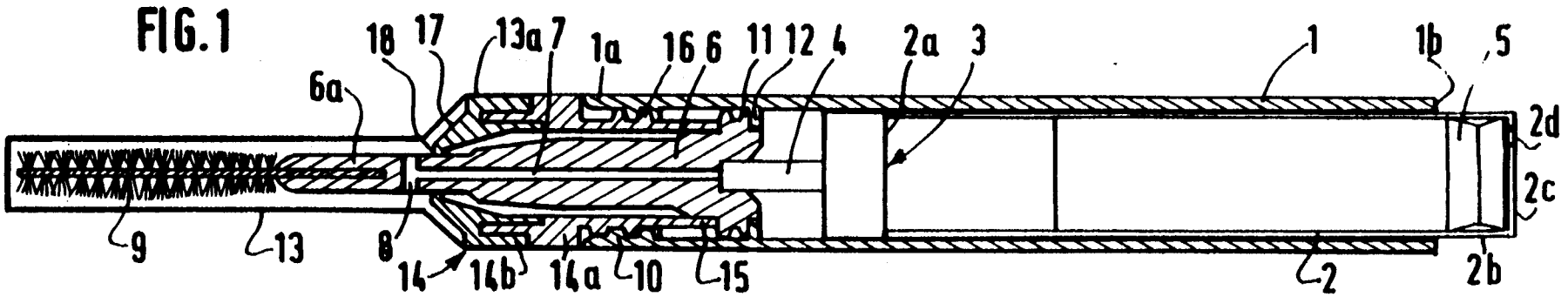
FIGS. 1 through 4 are schematic views in lengthwise section of a first embodiment of a device according to the invention in different positions during operation.

The makeup device according to the invention may essentially be characterized as comprising a cylindrical body capable of accommodating a sealed reservoir for a viscous or pasty makeup product, especially a mascara. The device includes means associated with said reservoir for effecting a measured dispensing of the product contained in the reservoir onto an applicator through an extension of the front opening in the reservoir. According to the invention, said applicator is permanently mounted on said cylindrical body in the vicinity of the front end of the reservoir, said applicator comprising a shaft at whose end an applying element is mounted, said shaft being provided with an internal passage terminating by at least one orifice at its periphery, and contacting the extension of the outlet of the reservoir. The device further includes a cap capable of covering said applicator and provided at its open end with means for its separable attachment by screwing onto said body in the vicinity of the said front end thereof, said means comprising a plug provided with an external thread capable of cooperating with an internal thread provided on the body, in the vicinity of its front end, the plug of said cap comprising, opposite said body, at least one extension forming a spreading surface for the product on the applying element of the applicator following removal of the cap. The spread product has previously been expelled through the outlet orifice or orifices provided on the shaft of the applicator and is located between the latter and the inside wall of the cap. This expulsion is accomplished by actuating measured dispensing means, preferably before removal of the cap.

Preferably, the applying element is composed of a brush, especially of the type with a metal core on which the brush hairs are mounted.

The applying element can likewise be composed of a screw, a spring, a plug, especially of thermoplastic foam or felt, or a pen, possibly an adhesive support containing varying lengths of cotton or wool fibers.

As indicated above, according to the invention the applicator is permanently mounted on the body. In other words, it remains integral with the latter both when the device is in the operating position and in the closed position. To this end, the shaft of the applicator can be permanently mounted in said body, being essentially made integral therewith or movable longitudinally therein.

To proceed to the makeup phase, it is sufficient with the device according to the invention to pull off the cap to cause the applicator to appear.

Owing to the design of the device according to the invention, the product contained in the reservoir is never in contact with the air, even during the makeup phase following removal of the cap.

The cylindrical body of the device according to the invention advantageously comprises open ends and the sealed reservoir for the product is advantageously a rigid reservoir slidably mounted inside said body between a position in which its rear end part projects from the open rear end of the body, and a position in which the rear end part of the reservoir is pushed into the inside of the body.

This rear end part of the reservoir constitutes an actuating pushbutton to expel a measured quantity of the product contained inside the reservoir.

To this end, the reservoir has at its front end a pump mechanism operable by displacement of the reservoir in the body in order to create a vacuum inside the reservoir.

The pump mechanism can be mounted directly on the reservoir and integrated therewith. In a variation on this, the pump mechanism can be mounted on a transfer part which serves as an adapter to connect in separable fashion the pump mechanism to the reservoir. In this case, a single pump mechanism can be successively mounted on a plurality of reservoirs constituting interchangeable refills.

To expel a measured quantity of the product through the front outlet nozzle of the reservoir onto the applicator, a sliding piston is provided in the reservoir, one side of said piston being in contact with the atmosphere, for example through an outlet opening provided in the rear bottom wall of the reservoir, said piston being displaced in the reservoir as a consequence of the vacuum created by the pump mechanism.

In a variation on this, the product can be contained in a pouch with a deformable wall located in the reservoir, subjected externally to atmospheric pressure for example, or by an opening made in the rear bottom wall of the reservoir, the measured quantity of the product being expelled from the pouch by the vacuum created by the actuation of the pump mechanism.

In one embodiment, the device is arranged so as not to allow actuation of the measured product dispensing means unless the device is in the closed position, in other words when the cap is mounted on the front end of the body.

To this end, means are provided for integrating temporarily, during the unscrewing and screwing of the cap off and onto the body, the plug of the cap with the shaft of the applicator. The plug has, in one particular embodiment, an internal extension with a cross section corresponding to the cross section of the end part, the applicator shaft ensuring a permanent tight mounting of the plug on the shaft.

Preferably, the cap has an internal shape allowing it to surround the applicator with slight play so as to leave room for only a small volume that can contain air between the applicator and the cap.

The cap is advantageously made of a bacteriostatic material or comprises an internal lining made of a bacteriostatic material to inhibit the growth of bacteria.

The interior surface of the cap can likewise be of silvered or copper-coated metal or can have a lining of gold or zinc. The cap can likewise be made as a part molded of thermoplastic material containing copper ions, silver ions, gold ions, or zinc ions, or particles of citric acid, salicylic acid, benzoic acid, or acetophenone.

For reasons primarily of aesthetics, the cap can be covered by an outer cap capable of being removed and put in place separately from the cap or at the same time as the latter.

Other advantages and characteristics of the invention will be apparent from reading the description which follows of two nonlimiting embodiments, with reference to the attached drawings.

The device according to the embodiments of FIGS. 1–4 comprises a rigid cylindrical body 1, open at its front end 1*a* and its rear end 1*b*, and inside which a rigid cylindrical container 2 is slidably mounted, for example a metal container, forming a reservoir for a makeup product (not shown) such as mascara. Reservoir 2 can be an interchangeable refill if necessary.

A pump mechanism designated generally by 3 is shown on front end 2*a* of reservoir 2.

Pump mechanism 3 is not shown in detail in the drawing and can be of any conventional type, capable when actuated of producing a vacuum inside the reservoir.

Pump mechanism 3 is installed on reservoir 2 after filling the latter with the makeup product and, by any conventional integration means, notably by crimping or screwing. In a variation not shown, especially when the reservoir is an interchangeable refill, pump mechanism 3 can be mounted on a transfer part that can be mounted in separable fashion on reservoir 2.

A product dispensing nozzle 4 is mounted projecting from the front end of the reservoir and, in conventional manner, contacts the inside of the reservoir when the pump mechanism is actuated.

Rear part 2*b* of the reservoir is terminated by a closed bottom 2*c* provided with at least one orifice 2*d* for causing a piston 5 to contact the external atmosphere, said piston being mounted freely in the reservoir and thus able to move in successive stages, toward the left in the drawing, upon each actuation of pump mechanism 3 due to the pressure differential resulting from the vacuum produced in the reservoir by the actuation of the pump mechanism and the atmospheric pressure acting on the rear face of piston 5.

Instead of a piston 5, it is possible to provide inside reservoir 2 a pouch made of deformable material containing the product.

Nozzle 4 is integral with a shaft 6 provided with an internal passage 7 terminating by orifices 8 at the periphery of the shaft.

At the front end 6*a* of the shaft a brush 9 is mounted, said brush having the traditional configuration for the application of a makeup product such as mascara.

Body 1 comprises in the vicinity of its front end 1*a* a wall section provided with an internal thread 10.

Shaft 6 has at its rear end a wall section provided with an external thread 11. Body 1 also has an annular extension 12 whose front face constitutes a rear stop for threaded section 11 of shaft 6 whose rear face constitutes a front stop face for pump mechanism 3.

Shaft 6 is installed in body 1 by screwing until its threaded section 11 goes beyond, moving rightward, threaded section 10 of the inside wall of body 1.

Hence, shaft 6 is displaceable relative to body 1 in the zone defined between the internally threaded section 10 and stop 12, while remaining permanently attached on body 1.

Shaft 6 is made at its rear end to fit around extension 4, as shown in FIG. 1.

Figure 4:
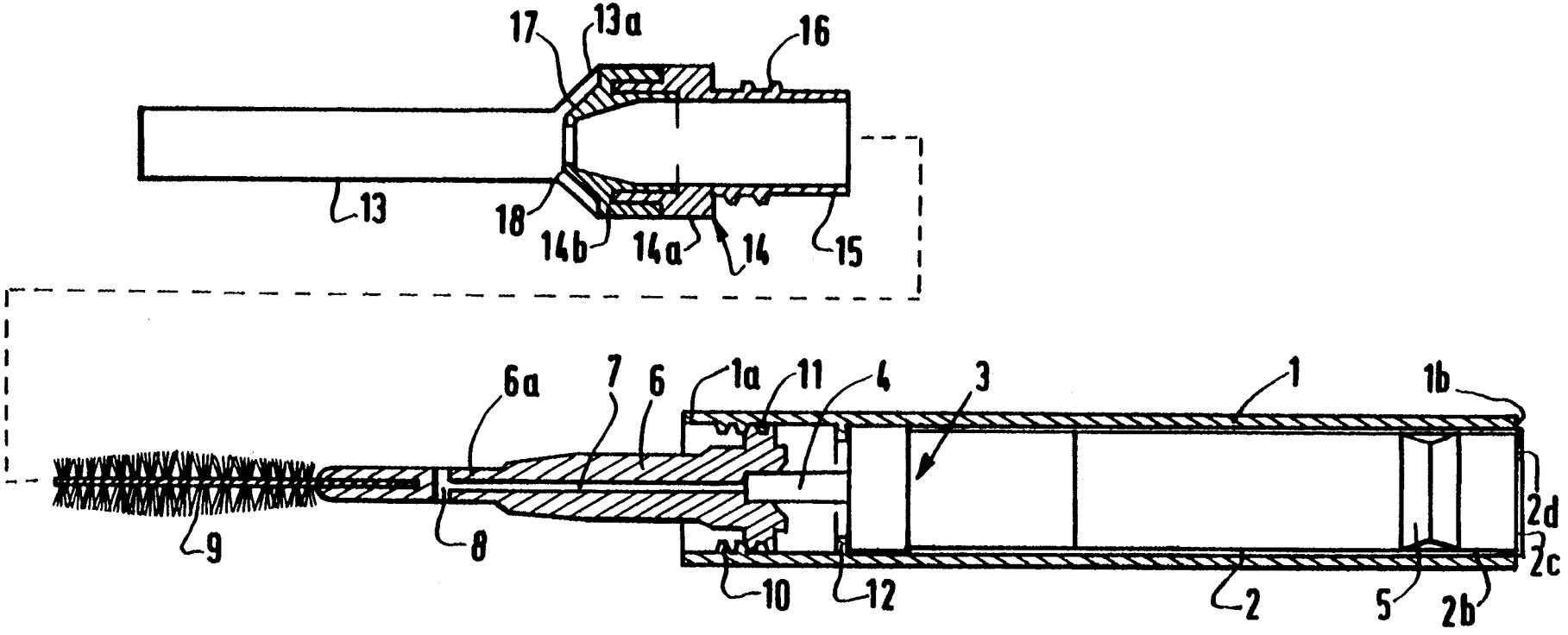

The assembly of components described so far constitutes an integral assembly as shown in FIG. 4.

The makeup device according to the invention comprises a second unit assembly which is best seen in FIG. 4 and which comprises a plug 13 preferably made of a bacteriostatic material or containing an interior lining of bacteriostatic material, capable of enclosing with slight play brush 9 and the front part of shaft 6*a* comprising the orifice or orifices 8 terminating at the periphery of the shaft.

Cap 13 is integral at its flared open end part 13*a* with a plug designated generally by 14 and which in the example shown, comprises two tubular parts 14*a*, 14*b* fitted one into the other. End part 14*a* has on a cylindrical section 15 an externally threaded section 16 that can mesh with threaded section 10 of body 1 for the screwing and unscrewing of cap 13 provided with plug 14 onto and off of body 1.

Tubular part 14*b* is provided with a frustoconical extension 17 for constituting a wringer-spreader mechanism for the product, on and around the shaft in the cap to apply it to brush 9 after separation of the cap from the body provided with the applicator composed of the shaft and the brush.

Frustoconical extension 17 is terminated by a cylindrical extension 18 whose inside diameter corresponds to the diameter of front part 6*a*of the shaft for permanent tight contact of plug 14 on shaft 6 making it possible to integrate these elements during the unscrewing and screwing phases respectively of cap 13 on and off body 1.

Figure 2:
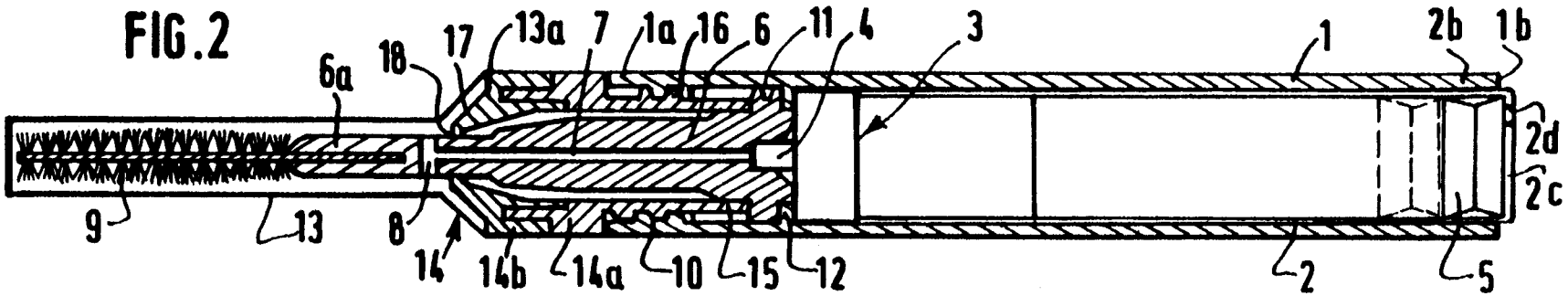

To obtain a measured expulsion of the product contained in reservoir 2, reservoir 2 is pushed toward the left in the drawing, by applying pressure to bottom 2*d*, until the position shown in FIG. 2 is reached. This displacement causes the actuation of pump mechanism 3 and displacement of piston 5 from the position shown in solid lines in FIG. 2 to the position shown by the dashed lines in this same figure. The movement of the piston causes the expulsion of a measured quantity of product through nozzle 4 of channel 7, and from orifice or orifices 8, into the volume delimited around the shaft by cap 13.

When the pressure on the bottom of the reservoir is relaxed, the latter returns to the position shown in FIG. 1, with the difference being that piston 5 is now advanced toward the left and is in a position corresponding to that shown in dashed lines in FIG. 2, as a result of contact of the rear face of the piston with the atmosphere through orifice 2*d*.

If a larger quantity of product is desired, the measured dispensing mechanism is actuated several times by pressing on the bottom of the reservoir several times.

Then cap 13 is removed by unscrewing.

In view of the permanent tight contact mentioned above between plug 14 and shaft 6, the latter is entrained during unscrewing of the cap, toward the left of the drawing, driving reservoir 2.

Figure 3:
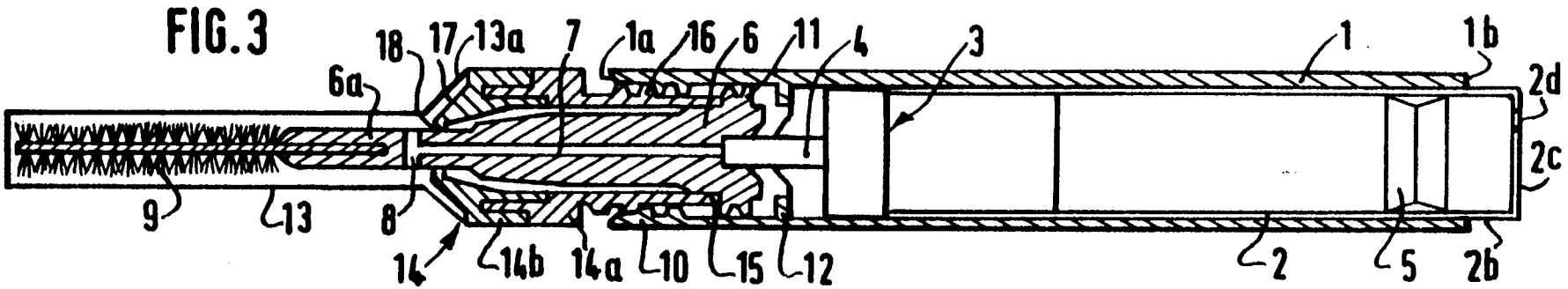

FIG. 3 shows an intermediate position during this displacement and FIG. 4 shows the end position after total separation of the cap, with the device then being in the operating position.

As can be seen in FIG. 4, in this operating position, rear end part 2*b* of the reservoir is inside body 1 so that it is not possible in this position to expel the product.

This is advantageous because the product if expelled in this position would be on the shaft in the vicinity of the orifice or orifices 8 and thus would not be properly spread on brush 9.

After screwing cap 13 back on, the shaft and reservoir are caused to move in the opposite direction, toward the right in the drawing, as far as the position shown in FIG. 1.

Figure 5:
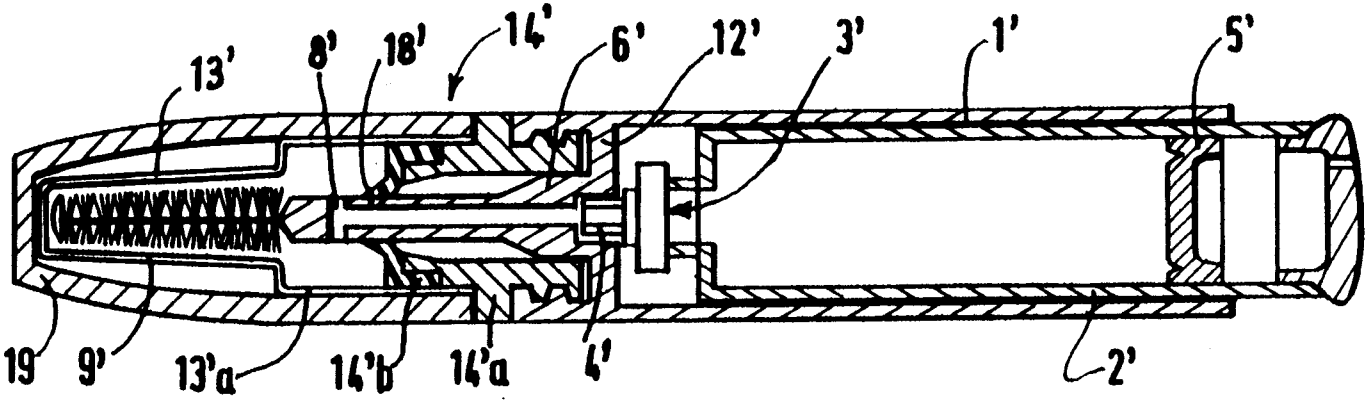
FIGS. 5 and 6 are similar views of a second embodiment of the device according to the invention, in the closed and open operating positions respectively.
Figure 6:
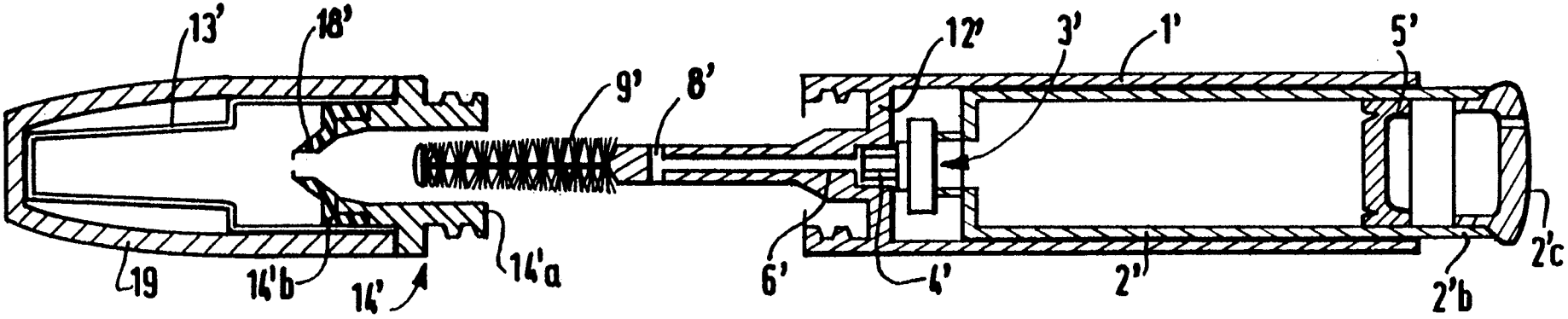

The second embodiment shown in FIGS. 5 and 6 differs essentially from the embodiment shown in FIG. 1 by the fact that shaft 6′ is made integral with annular stop wall 12′ provided inside body 1′.

In this embodiment, shaft 6′ is therefore not mobile relative to the body during the screwing and unscrewing of cap 13′, provided with its plug 14′.

Cylindrical extension 18′ of the plug is no longer in permanent tight contact around the shaft but has a small amount of play around the latter.

Other differences relative to the first embodiment include in particular the following characteristics which do not affect the function:

Cap 13′ has a flared part 13′*a*, cylindrical in shape, defining a larger annular volume around the orifice or orifices 8′ of the shaft.

Bottom 2′*c* of reservoir 2′ is made in the shape of the added part.

For measured expulsion of the product, the function of the device according to the second embodiment is the same as that of the first embodiment, with the expulsion of the product being preferably effected when the device is in the assembled position shown in FIG. 5.

The essential functional difference relative to the first embodiment is that in the second embodiment pressure upon end part 2′*c* of the reservoir is possible when the device is in the disassembled position shown in FIG. 6, due to the fact that in this case rear part 2′*b* of the reservoir projects from the rear end of body 1′.

In this embodiment, a protective outer cap 19 has been shown, which has no inherent functional characteristics but contributes to the general appearance by extending the body wall.

A cap of this kind can of course likewise be provided in the first embodiment in FIGS. 1 to 4.

What is claimed is:

1. Makeup device, comprising:

a cylindrical body having a front end and accommodating a sealed reservoir which contains a makeup product, said reservoir having a front opening with a nozzle in said front opening;

an applicator mounted permanently on said cylindrical body in the vicinity of said front end of said body, said applicator comprising a shaft at whose end is mounted an applying element, said shaft being provided with an internal passage terminating by at least one orifice at a periphery of said shaft, and said passage being located such as to be in fluid communication with said nozzle of said reservoir, so that an inside of said reservoir can communicate with an outside only through said shaft of said applicator; and a cap having an open end capable of covering said applicator with slight play and said cap having a plug, said cap being capable of separably attaching at said open end by screwing to said body in the vicinity of said front end of said body via said plug, said plug being provided with an external thread capable of meshing with an internal thread made on said body in the vicinity of said front end, said plug having opposite said body at least one extension forming a surface for spreading said product from said at least one orifice onto said applying element of said applicator during removal of said cap.

2. Device according to claim 1, further comprising a reservoir having a front end and a rear bottom wall, said reservoir being capable of dispensing product contained in said reservoir through a nozzle in a front opening said reservoir onto said applicator.

3. Device according to claim 2, wherein said reservoir has at its front end a pump mechanism which can be actuated as a result of the displacement of said reservoir in said body to produce a vacuum inside said reservoir.

4. Device according to claim 3, wherein said pump mechanism is attached to said reservoir.

5. Device according to claim 3, wherein said pump mechanism is separably mounted on said reservoir.

6. Device according to claim 3, wherein said reservoir contains a slidable piston having at least one face, said face being in contact with atmosphere, said piston being displaced in the reservoir as a result of the vacuum created by the pump mechanism, in order to expel a measured quantity of product through said nozzle of said reservoir onto said applicator.

7. Device according to claim 6, wherein said face is in contact with the atmosphere through an orifice provided in said rear bottom wall of said reservoir.

8. Device according to claim 3 wherein said reservoir contains a pouch with a deformable wall containing said product, said pouch being subjected externally to atmospheric pressure, a measured quantity of said product being expelled from said pouch as a result of the vacuum created by the operation of said pump mechanism, in order to expel said measured quantity of product through said nozzle of said reservoir onto said applicator.

9. Device according to claim 8, wherein said pouch is subjected externally to atmospheric pressure through an orifice made in said rear bottom wall of said reservoir.

10. Device according to claim 1, wherein said shaft is permanently mounted in said body and is made integral with said body.

11. Device according to claim 1, wherein said shaft is movable longitudinally within said body.

12. Device according to claim 1, wherein said cylindrical body has open ends and a sealed reservoir having a rear end part is slidably mounted inside said body between a position in which said rear end part of said reservoir extends from an open rear end of said body and a position in which said rear end part of reservoir is enclosed inside said body.

13. Device according to claim 1, wherein said plug has an internal extension with a cross section corresponding to a cross section of an end of said applicator shaft for a tight mounting of said plug on said shaft.

14. Device according to claim 1, wherein said cap is made of a bacteriostatic material.

15. Device according to claim 1, wherein said cap is covered by an external cap.

16. Device according to claim 1, wherein said reservoir is an interchangeable refill.

17. Device according to claim 1, wherein said applying element is a brush.

18. Device according to claim 1, wherein said sealed reservoir contains mascara.

19. Device according to claim 1, wherein said cap has an internal coating of a bacteriostatic material.

* * * * *